United States Patent [19]

Rae et al.

[11] Patent Number: 4,936,737

[45] Date of Patent: Jun. 26, 1990

[54] LOADER MOUNTING SYSTEM

[75] Inventors: Rory Rae, Port Colborne; Henry Friesen, Niagara Falls; Nicholas Hamm, Vineland, all of Canada

[73] Assignee: Deere & Company, Moline, Ill.

[21] Appl. No.: 236,803

[22] Filed: Aug. 26, 1988

[51] Int. Cl.[5] ..... E02F 3/627

[52] U.S. Cl. ..... 414/686; 172/273; 280/759

[58] Field of Search ..... 414/686, 723, 786; 280/759; 172/272-275

[56] References Cited

U.S. PATENT DOCUMENTS

| | | | |
|---|---|---|---|
| 3,939,997 | 2/1976 | Frank | 172/275 |
| 3,991,890 | 11/1976 | Frank | 172/275 |
| 4,033,469 | 7/1977 | Frank | 172/272 |
| 4,116,346 | 9/1978 | Uchida | 74/520 |
| 4,217,075 | 8/1980 | Frank | 172/274 |
| 4,436,477 | 3/1984 | Lenertz et al. | 414/723 |
| 4,565,484 | 1/1986 | Hamada et al. | 414/686 |
| 4,637,772 | 1/1987 | Stumpe | 172/274 |

FOREIGN PATENT DOCUMENTS

| | | | |
|---|---|---|---|
| 3151279A1 | 7/1983 | Fed. Rep. of Germany . | |
| 2305337 | 10/1976 | France | 280/759 |
| 2131391A | 6/1984 | United Kingdom . | |

OTHER PUBLICATIONS

Co-pending parent application Ser. No. 073,601, filed 15 Jul. 1987 by Nicholas Hamm entitled Loader Mounting System and assigned to Deere & Company, now U.S. Pat. No. 4,793,764.

*Primary Examiner*—Robert J. Spar
*Assistant Examiner*—Donald W. Underwood

[57] ABSTRACT

Front end loader mounting structure including a rear support assembly for receiving pivot tubes located at the lower ends of the rear upright mast posts. A round cross tube connecting the forward ends of the mast arms is rotatable upwardly through an arc-shaped path with center of radius of the path located on the axis of the pivot tubes. The cross tube is received within an inverted cradle assembly located directly in the path and is releasably locked in a raised mounted position within the cradle assembly by latching structure remotely actuated from the tractor cab. The mast posts include downwardly extending projections which are freely received by the support assembly when the loader is in the stored position but which rotate against a locking block to secure the posts tightly to the tractor frame as the mast arms approach the upwardly rotated position.

21 Claims, 6 Drawing Sheets

Fig. 8
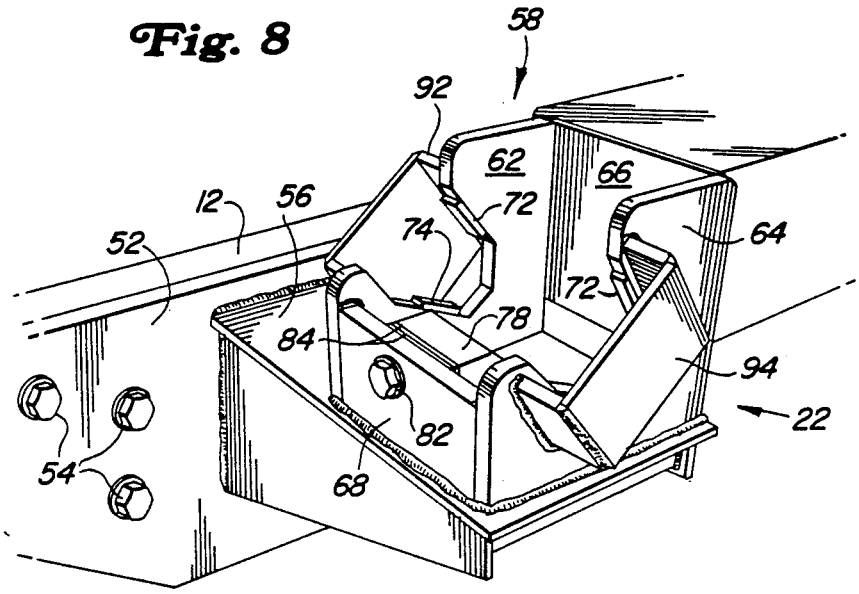
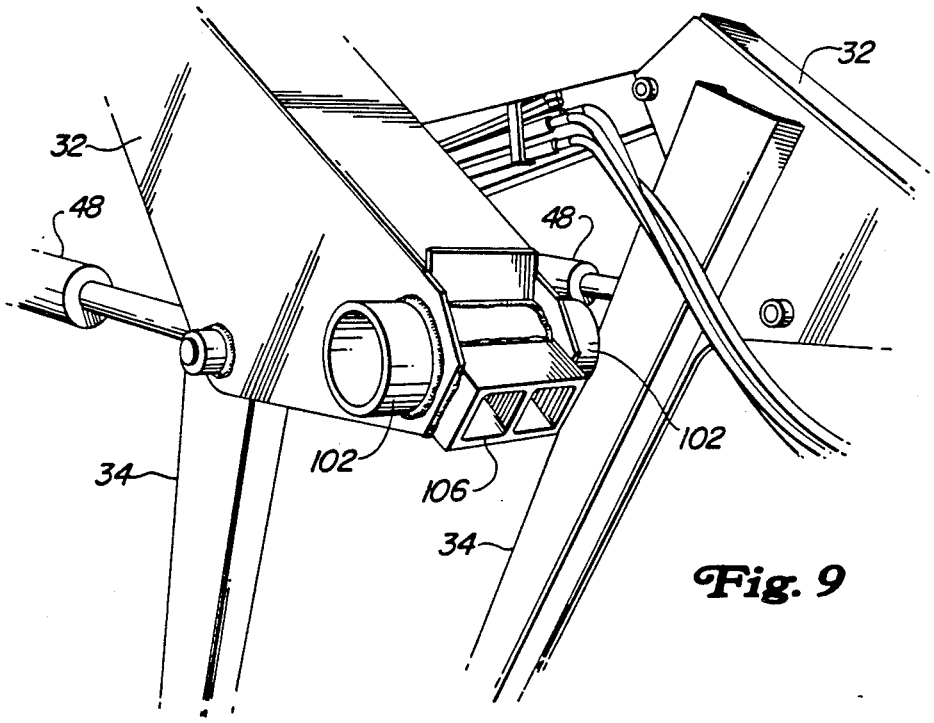
Fig. 9

LOADER MOUNTING SYSTEM

BACKGROUND OF THE INVENTION

The present invention relates generally to loaders for mounting on tractors or similar implements, and more specifically to an improved loader mounting arrangement.

Numerous systems are available to remove and install a loader with respect to a tractor frame. A loader must be easily and quickly removable from and installable on the tractor. Many loader mounting systems are not always easily understood nor are they always reliable. With some loader arrangements, portions of the loader must be slid across the tractor frame or loader supports or the tractor must be moved relative to the loader during mounting and dismounting. Some arrangements require frequent trips on and off the tractor cab to align apertures and/or insert or remove pins or other mounting structure.

With some loader mounting arrangements, the mounting brackets on the tractor are cumbersome and must be removed when the loader is removed to free up the tractor for normal operation or to permit other attachments such as front end weights to be connected to the tractor once the loader is removed. Removing and installing tractor brackets can be a time-consuming process.

BRIEF DESCRIPTION OF THE INVENTION

It is therefore an object of the present invention to provide improved mounting structure for attaching a tractormounted loader. It is a further object to provide such a structure which overcomes many of the problems related to previously available loaders.

It is yet another object of the present invention to provide an improved loader mounting structure which facilitates mounting and storing of the loader and provides a reliable, rigid connection between the tractor frame and the loader. It is a further object to provide such structure which obviates separate mounting hardware such as pins or bolts. It is a further object to provide such structure which reduces the number of times an operator has to leave the tractor cab during mounting or dismounting of the loader.

It is still another object of the present invention to provide an improved loader mounting structure wherein the loader mast may be rotated between the mounted and dismounted positions relative to the tractor frame without having to move the tractor relative to the loader or slide the loader over the tractor frame or support assemblies. It is a further object to provide such structure with an improved rear mounting arrangement which automatically secures the rear mast posts to the tractor frame as the mast is rotated to the mounted position. It is a further object to provide such structure with an improved front mounting arrangement which receives a front cross-tube member on the loader as the mast is rotated to the mounted position and which is latchable without need for the operator to leave the cab of the tractor.

It is a further object to provide loader mounting structure wherein the front mounting bracket may remain with the tractor when the loader is removed from the tractor, and wherein the front mounting bracket serves as a front end weight support when the loader is removed.

A loader constructed in accordance with the teachings of the present invention includes an upwardly and forwardly opening cradle assembly mounted on the tractor frame and adapted to receive pivot structure at the lower ends of the rear mast posts of the loader. The lift cylinders are retracted to cause the pivot structure to settle into the rear support cradles. Once the pivot structure engages the rear support, continuing to retract the lift cylinders raises the mast about the pivot structure. A downwardly opening front support bolted to the front of the tractor receives a front cross tube on the mast which is locked into position in the front support from the tractor seat by moving a cable-actuated locking block against a latch pivotally connected to the front support structure. The rear mounting structure includes an extension projecting from the pivot structure and a block located at the lower end of the rear cradle assembly which is engaged by the extension as the mast reaches the upwardly rotated mounted position to prevent the pivot structure from moving out of the cradle assembly. The front support assembly includes structure for mounting front tractor weights when the loader is removed from the tractor.

The loader may be attached to or removed from the tractor without requiring numerous trips by the operator from the tractor cab. The mounting structure provides a tight connection between the loader and the tractor without need for pins or other attaching hardware and eliminates the need to slide the loader over portions of the tractor frame or support structure. The support structure may be left on the tractor after the loader is removed without interfering with the normal operation of the tractor. The front mounting arrangement permits tractor weights to be used even when the support structure remains on the tractor.

These and other objects, features and advantages of the present invention will become apparent to those skilled in the art from the description which follows and from the drawings.

BRIEF DESCRIPTION OF THE DRAWINGS

FIG. 8 is a perspective view of the rear cradle assembly.

FIG. 9 is a perspective view of the lower portion of the mast post.

DESCRIPTION OF THE PREFERRED EMBODIMENT

Figure 1:
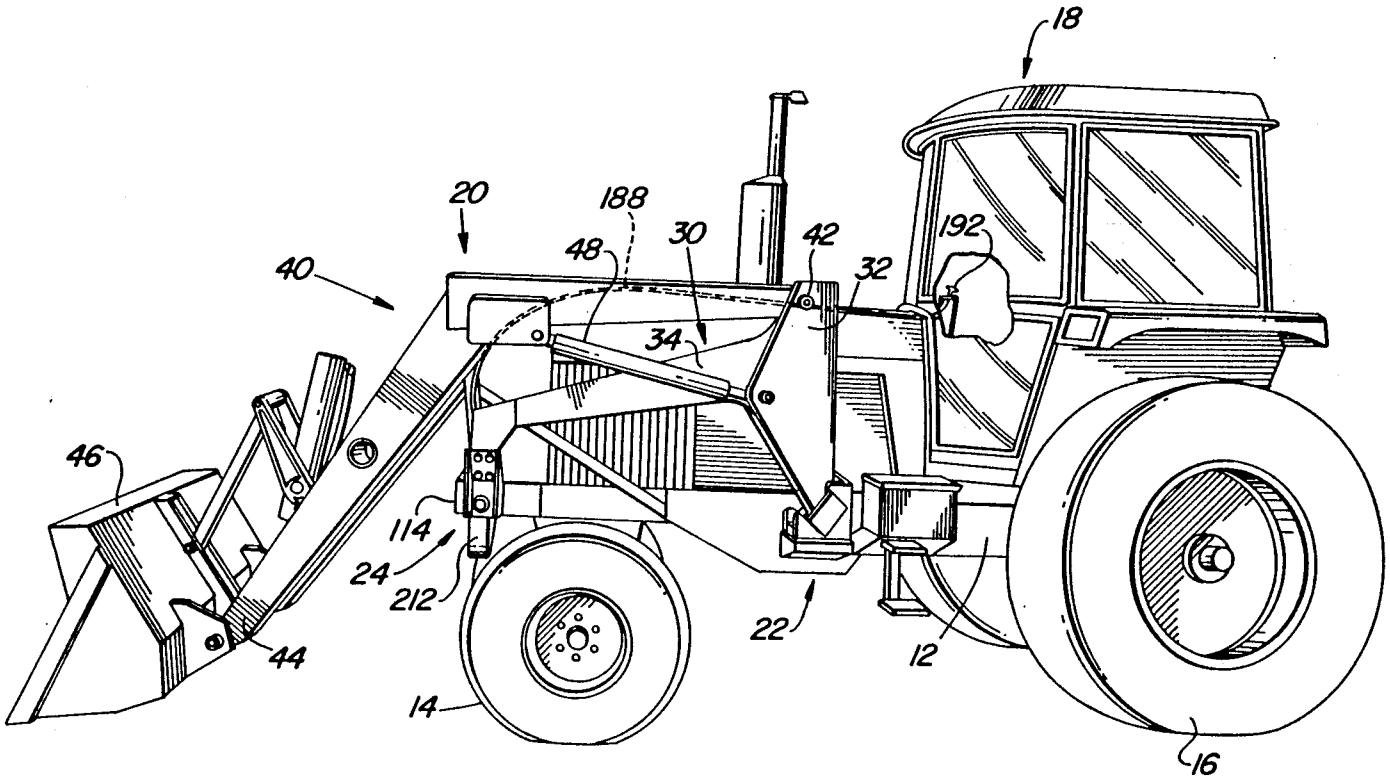
FIG. 1 is a side view of a tractor with the loader mounted thereon.

Referring to FIG. 1, there is shown a tractor 10 having a main frame 12 supported by front and rear wheels 14 and 16 for forward movement over the ground. The tractor 10 includes a cab 18.

A front end loader 20 is supported from the tractor frame 12 by rear support assemblies 22 located at the sides of the frame 12, and by a front support assembly 24. The loader 20 includes a mast 30 having upright rear mast posts 32 with forwardly extending mast arms 34 rigidly connected near the central portion of the posts 32. A boom 40 is pivotally connected at locations 42 to the upper ends of the mast posts 32. The boom 40 extends forwardly and downwardly from the pivotal connection 42 to a bucket-receiving end 44 which carries a conventional loader bucket 46 or other boom-mounted implement. Boom actuating cylinders 48 are connected between the central portion of the mast posts 32 and the knee area of the boom 40. The cylinders 48 are extendable and retractable by conventional hydraulic circuitry (not shown) connected to the tractor hydraulic system to pivot the boom 40 upwardly and downwardly about the pivotal locations 42 and to rotate the mast 30 during mounting and dismounting.

Figure 10:
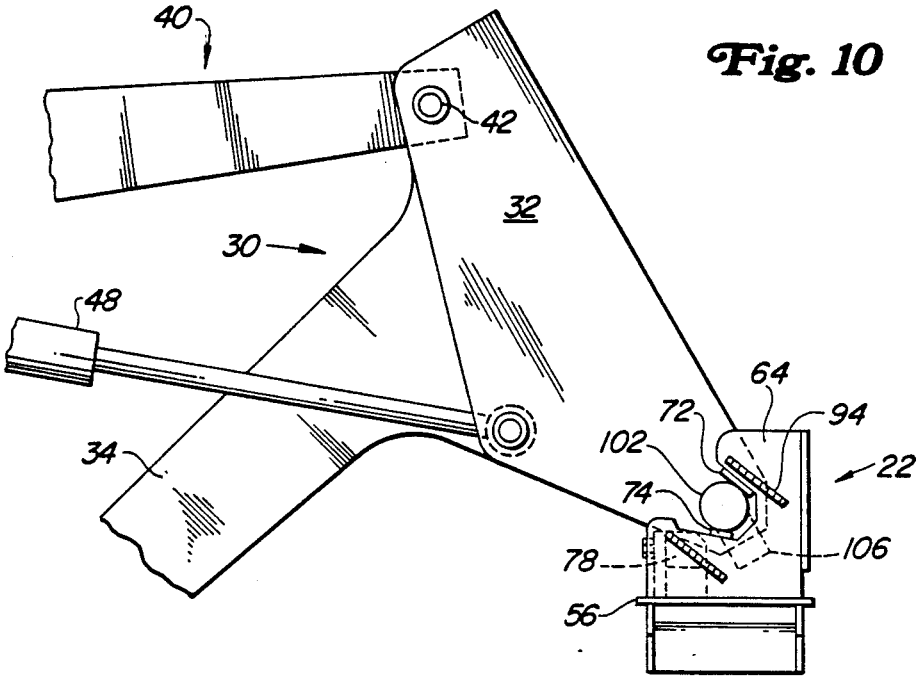
FIG. 10 is a side view partially in section showing the mast post pivot structure in the cradle assembly with the mast generally in the parked position.

The rear support assemblies 22 each include a mounting bracket 52 (FIG. 8) connected to the frame 12 by bolts 54. Horizontal support structure 56 is welded to the bracket 52 and carries upwardly and forwardly opening cradle structure indicated generally at 58. The cradle structure 58 includes a pair of upright notched plates 62 and 64 welded to the horizontal support structure 56 and spaced by a rear wall 66 and a front wall 68. As shown in FIG. 8, the notches in the walls 62 and 64 open upwardly and forwardly and diverge in the downward direction. Bearing plates 72 and 74 are connected to the upper and lower surfaces of the notches adjacent the lower ends thereof. A locking block 78 is supported between the forward ends of the plates 62 and 64 adjacent the notches by a bolt 82 passing through the plate 68 and threaded into the block 78. Shims 84 are added as necessary between the block 78 and the plate 68 to adjust the fore-and-aft location of the block 78. Funnel plates 92 and 94 are welded to and extend outwardly from the plates 62 and 64, respectively, and are used to guide the lower end of each mast post 32 into the cradle structure 58, as will be described in detail below. As best seen in FIG. 9, the lower end of each mast post 32 includes pivot structure 102 preferably in the form of a circular beam which extends through and is welded to the opposite sidewalls of the mast post 32. A restraining block or extension member 106 is welded to the lower portion of the pivot structure 102 between the sidewalls of the mast post 32 and projects downwardly below the sidewalls of the mast 32. The block 106 extends generally parallel to the rear wall of the mast post 32. As can be appreciated best from FIGS. 8–11, when the loader 20 is in the storage position with the mast arms 34 angled downwardly and the mast posts 32 angled forwardly, the pivot structure 102 and the restraining block 106 are situated such that the lower end of each mast post 32 can easily enter the cradle structure 58 with the funnel plates 92 and 94 guiding the lower end of the mast post into the notches in the plates 62 and 64 and with the restraining block 106 projecting into the lower rear portion of the cradle structure 58. As seen in FIG. 10, the lower end of the mast post 32 can move downwardly and rearwardly until the pivot structure 102 is wedged between the bearing plates 72 and 74. Thereafter, rotation of the mast posts 32 in the clockwise direction (as viewed in FIGS. 10 and 11) about the pivot structure 102 rotates the restraining block 106 forwardly into contact with the block 78 (FIG. 11) urging the restraining block 106 against the locking block 78 to tightly wedge the pivot structure 102 between the plates 72 and 74 and restraining forward movement of the lower end of the mast post 32. The cradle structure 58 prevents movement of the lower end of the mast post 32 in the rearward, upward and sideways directions to provide a very tight fit between the mast 30 and the tractor frame 12. When the loader 20 is first mounted on the tractor 10, shims 84 may be added or removed to ensure that the lower portion of the mast post 32 is rigidly supported in the rear support assembly 22.

Figure 4:
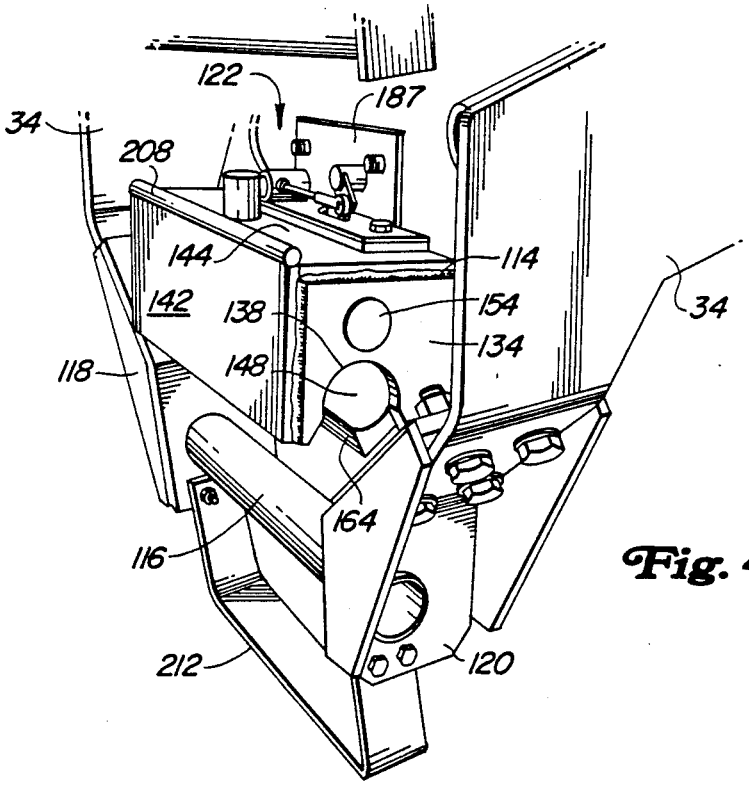
FIG. 4 is a front perspective view of the front support assembly with the loader mast cross tube rotated downwardly from the mounted position.

The front support assembly 24 (FIGS. 3-7) includes an inverted cradle assembly 114 bolted to the front end of the tractor frame 12. A transversely extending round cross tube 116 is connected between the lower forward ends of the mast arms 34 by brackets 118 and 120 (FIG. 4). As the mast arms 34 are rotated upwardly about the pivot structures 102, the cross tube 116 moves generally in an arc of a circle centered on the axis of the pivot structure 102 and engages the cradle assembly 114. After the cross tube 116 bottoms in the cradle assembly 114, a cable-operated latching arrangement, indicated generally at 122, is activated to secure the tube 116 in the cradle assembly 114, after which the loader 20 is ready for operation.

The inverted cradle assembly 114 is connected to the forwardmost portion of the frame 12 by bolts 126 which extend through a rear plate 128. Transversely spaced side plates 132 and 134 extend forwardly from the outermost edges of the rear plate 128 and are notched or open in a channel-shaped configuration at 136 and 138 to receive the cross tube 116 as the tube moves in the arc-shaped path. The lower portions of the openings 136 and 138 diverge in the downward direction to guide the tube 116 into the upper ends of the notches 136 and 138 which conform generally to the shape of the tube 116. A front plate 142 is welded to the forward edges of the side plates 132 and 134 and to the forward edge of a top portion 144 which generally encloses the top of the cradle assembly 114.

Latches 146 and 148 are pivotally connected adjacent their upper ends by pivot structures 152 and 154 to the upper portions of the side plates 132 and 134, respectively above the notches 136 and 138. The latches 146 and 148 are generally C-shaped and can pivot between an open position (FIG. 6) and a latching position (FIG. 5) wherein the latch closes around the cross tube 116 when the tube is bottomed in the cradle assembly 114. The lower portions of the C-shaped latches extend under the tube 116. The weight of the latches 146, 148 generally biases them about their pivot structure 152, 154 toward the closed position. The lower forward faces indicated generally at 162, 164 are angled such that the cross tube 116 will push the latches 146, 148 toward the open position as the tube moves into the cradle assembly 114. Once the tube 116 is seated in the cradle assembly, the latches 146, 148 swing back toward the closed position, and the cable-operated latching arrangement 122 is activated to secure the latches in the closed position.

The latching arrangement 122 includes a transversely extending locking block 172 slidably positioned adjacent the rear plate 128 and movable vertically by an upright pin or bolt 174 threaded into the central portion of the block 172. The block 172, in a lowered locking position (FIG. 5) wherein the front face of the block engages the rear faces of the latches 146 and 148, prevents movement of the latches away from the latching position. To release the latches 146 and 148 from around the cross tube 116, the block 172 is lifted (FIGS. 6 and 7) to permit the latches 146 and 148 to pivot rearwardly to their open positions which releases the cross tube 116 from the cradle assembly 114.

Figure 5:
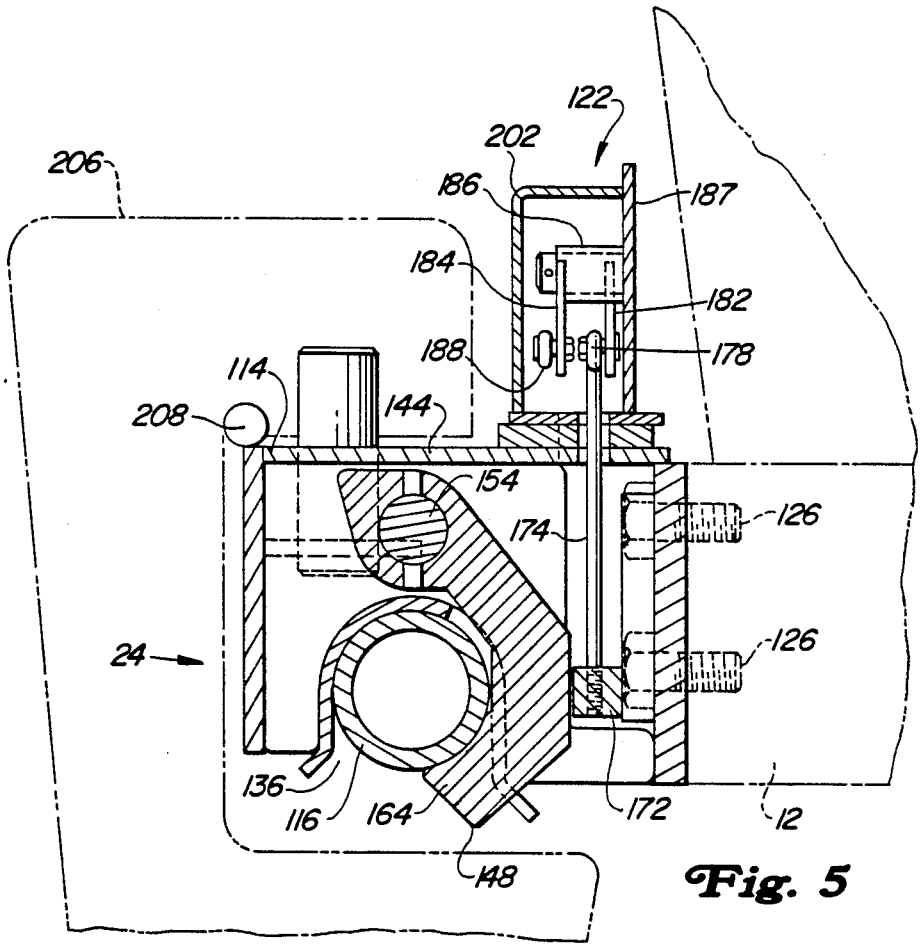
FIG. 5 is a side view in section showing the front support assembly and the position of the tractor weights (broken lines) when mounted on the support assembly.
Figure 3:
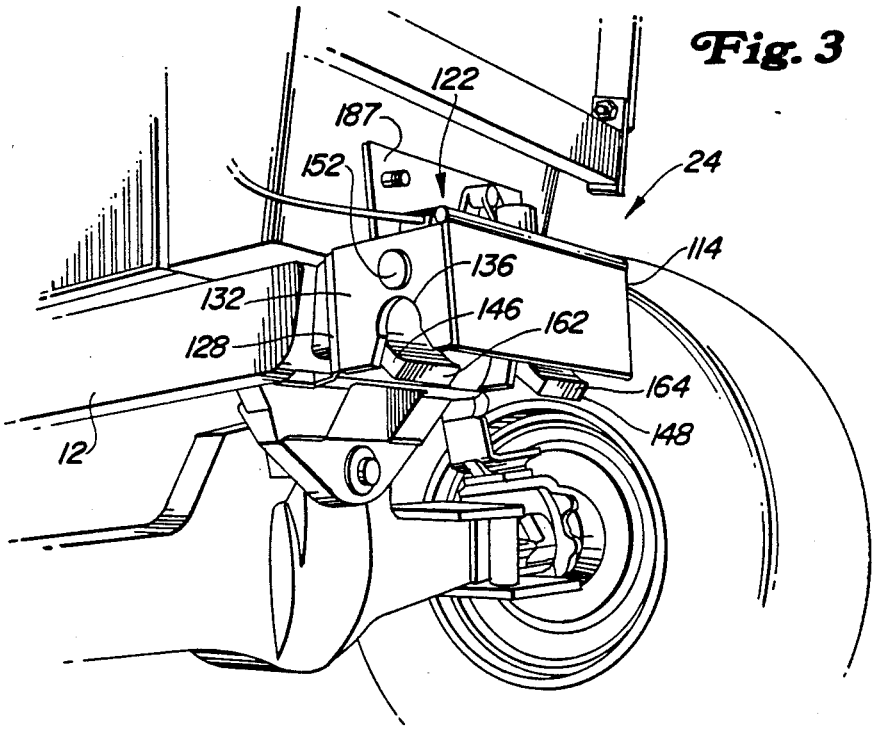
FIG. 3 is a front perspective view of the front support assembly with the loader removed therefrom.
Figure 6:
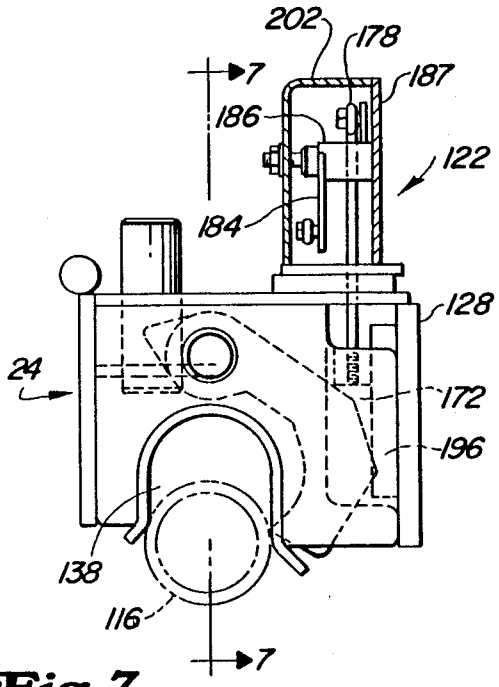
FIG. 6 is a side view of the front mounting structure as the mast cross tube approaches the mounted position.
Figure 7:
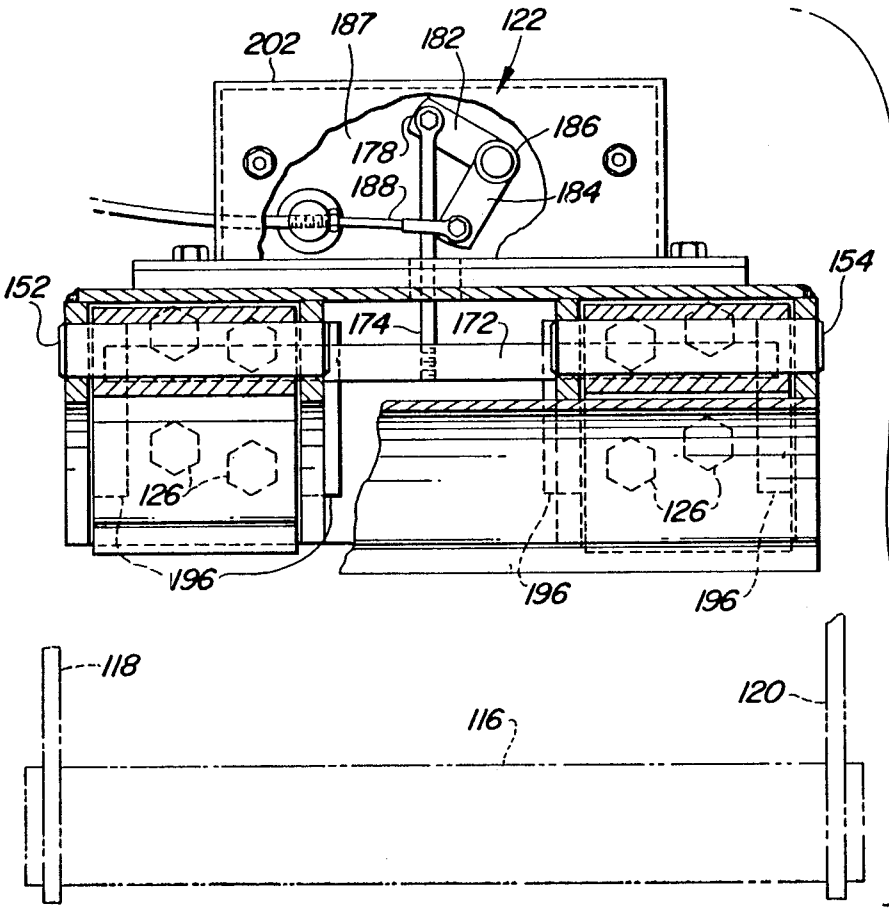
FIG. 7 is a view taken substantially along lines 7—7 of FIG. 6.

The pin 174 includes an upper eye-end 178 pivotally connected to one end of a lever 182. The opposite end of the lever 182 is fixed for rotation with a second lever 184 to a pivot 186 supported on an upright plate 187. The outer end of the second lever 184 is pivotally connected to the end of a pushpull cable 188 or other mechanical linkage which extends to a control knob or handle 192 (FIG. 1) located in the tractor cab 18. Pushing the cable 188 rotates the levers 182 and 184 in the counterclockwise direction as seen in FIG. 7 and pushes the locking block 172 downwardly toward the latching position. Pulling the cable 188 rotates the levers 182 and 184 in the clockwise direction and lifts the locking block 172 toward the unlatching position (FIG. 6). The locking block 172 slides against upright guide members 196 which properly position the block 172 in the fore-and-aft direction and provide a firm backing for the block 172 when it secures the latches 146 and 148 in the latching position as shown in FIG. 5. A protective shield 202 is bolted over the latching arrangement 122 to prevent contamination of the assembly.

The cradle assembly 114 is shaped to accommodate the recess on a conventional tractor weight 206 (FIG. 5) so that the assembly 114 may be left on the front of the tractor for use as a front end weight support when the loader 20 is removed. A bar 208 of circular cross section is welded across the front upper edge of the assembly 114 to receive the corresponding notch in the tractor weight 206.

A U-shaped stand 212 (FIG. 4) is bolted to the lower ends of the brackets 118 and 120 and supports the loader on the ground (FIG. 2) when removed from the tractor. The loader 20 may be stored in the raised extended position as shown in FIG. 2, or the cylinders 148 may be retracted so that it may be stored in a collapsed position.

Figure 2:
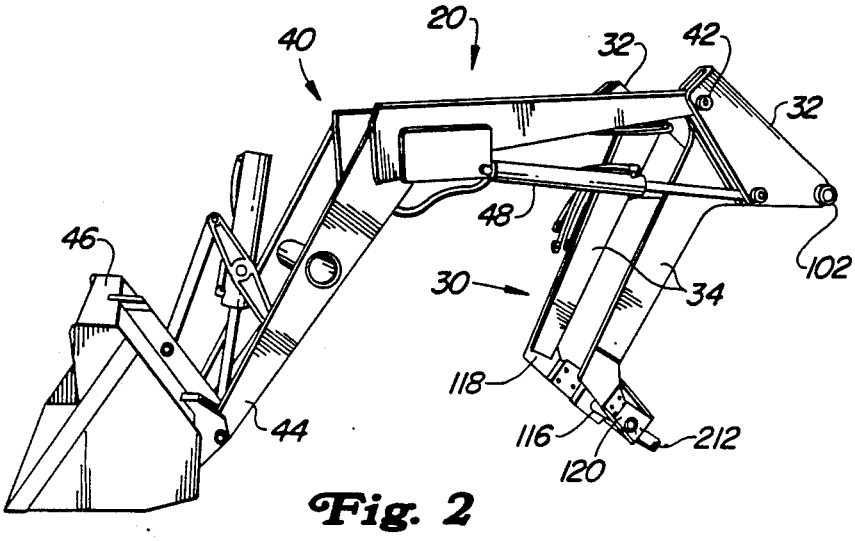
FIG. 2 is a side perspective view of the loader in the mounted position.

To mount the loader 20, the tractor 10 is driven between the mast arms 34 with the cylinders 48 in the extended position as shown in FIG. 2 until the tubes 102 are located above the corresponding rear support assemblies 22. The loader hydraulic lines are connected to the tractor, and the boom cylinders 48 are retracted so that the tubes 102 are guided into the cradle structure 58 by the funnel plates 92 and 94. Initially, the loader 20 rests on and pivots about the stand 212. Once the tubes 102 at the lower ends of the mast posts 32 engage the rear supports 22 as shown in FIG. 10, the tubes 102 become the pivot points for the loader installation. Continued retraction of the cylinders 48 pivots the mast arms 34 about the tubes 102 and lifts the front end of the mast arms 34 until the cross tube 116 engages and bottoms against the inverted cradle assembly 114 (FIG. 5). As the tube 116 moves into the cradle assembly 114, the latches 146 and 148 are pivoted out of the way (the latching block 172 is raised by pulling the control knob 192 at the cab prior to this point). Once the tube 116 bottoms against the cradle assembly 114, the operator pushes the control knob 192 at the cab to move the locking block 172 downwardly against the backs of the latches 146 and 148 to rigidly secure the cross tube 116, and thus the loader 20, to the forward end of the tractor frame 12.

Figure 11:
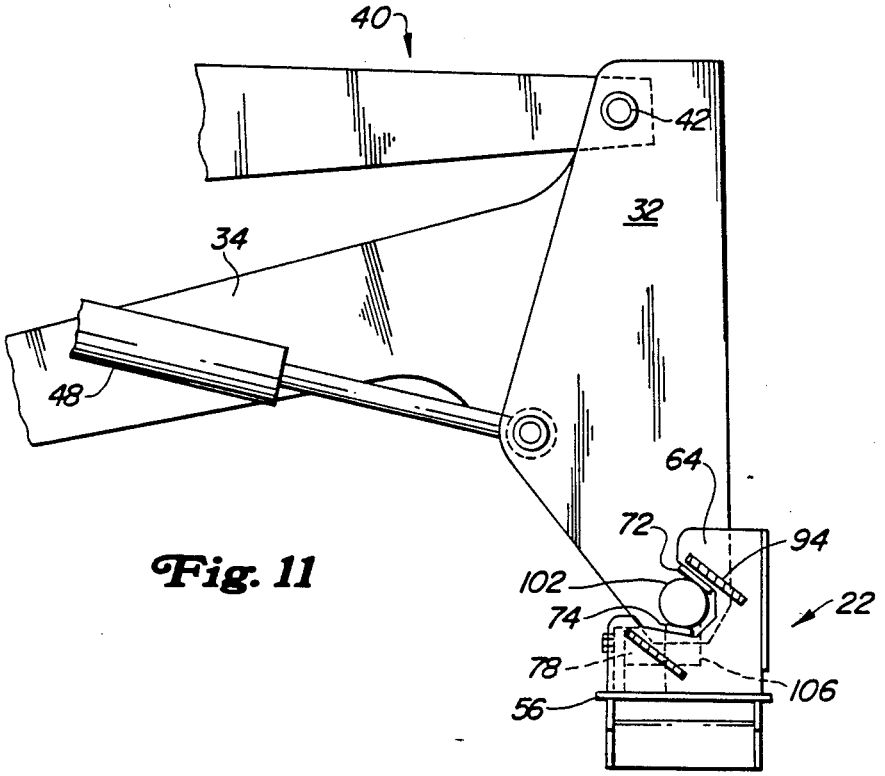
FIG. 11 is a view similar to FIG. 10 but showing the mast rotated upwardly to the mounted position.

As the front of the mast arms 34 are rotated upwardly about the tubes 102 from the positions shown in FIG. 10 to the final attached position shown in FIG. 11, the restraining blocks 106 which extend downwardly from each of the tubes 102 move from a first attitude, wherein entry of the lower portions of the mast posts 32 into the cradle structures 58 is facilitated, to a locking position as shown in FIG. 11 wherein each block 106 is rotated tightly against the locking block 78 to prevent forward movement of the lower ends of the mast posts 32 while the cradle structures 58 restrains the bottom of the mast posts in the remaining directions. The arrangement of the locking and restraining blocks 78 and 106 assures that a major portion of the load is taken up by the portions of the cradle structure 58 other than the blocks 78. The above-described block structure also requires that the mast posts 32 be rotated nearly to their final upright mounted positions as shown in FIG. 11 before the mast structure is locked into the cradle structure 58. This arrangement facilitates easy entry of the lower portion of the mast posts into the cradle structure during mounting and easy withdrawal of the lower ends of the posts from the cradle structure 58 during removal. One can see from the abovedescribed arrangement, that the entire mounting or dismounting procedure can be accomplished from the seat of the tractor with the exception of connecting and disconnecting the hydraulic hoses. No loose tools or loose hardware are required, and the system is very simple and easy to understand and yet provides a very rigid and secure locking arrangement. The cross tube 116 is rotated in an arc about the tubes 102 directly into and out of the inverted cradle assembly 114 without having to drag the loader over the tractor frame or mounting structure and without having to move the tractor forwardly or rearwardly during mounting and dismounting. The front support assembly 24 can remain connected to the tractor after the loader 20 is removed without sacrificing the ability to mount front end weights on the tractor.

Having described the preferred embodiment, it will be apparent that modifications can be made without departing from the scope of the invention as defined in the accompanying claims.

We claim:

1. In a loader having a mast including rear upright mast posts and mast arms extending forwardly from the mast posts, said loader also having a boom assembly pivotally connected to the mast posts, mounting structure for connecting and disconnecting the loader relative to a fore-and-aft extending tractor frame comprising:

a rear support assembly mounted on the tractor frame including means for pivotally supporting the lower ends of the mast posts from the frame for rocking about a generally transverse axis defined by the rear support assembly;

a transverse member fixedly connected between the forward ends of the mast arms;

means for rocking the mast about the rear support assembly and moving the transverse member in an arc-shaped path having a radius generally centered on the transverse axis, the transverse member movable between a downwardly directed storage position wherein the transverse member is located adjacent the surface of the ground and a raised mounted position;

a front support assembly connected to the forward end of the tractor frame and opening downwardly into the path of the transverse member for receiving the transverse member as the transverse member moves upwardly toward the mounted position; and means for releasably latching the transverse member to the front support assembly in the raised mounted position.

2. The invention as set forth in claim 1 wherein the transverse member comprises a cross tube, the front support assembly comprises downwardly opening U-shaped structure lying generally along the arc-shaped path and the means for latching includes a latch movable under the cross tube as the tube moves up into the U-shaped structure.

3. The invention as set forth in claim 2 including remotely actuatable locking structure for releasably securing the latch under the transverse member.

4. In a loader having a mast including rear upward mast posts and mast arms extending forwardly from the mast posts, said loader also having a boom assembly pivotally connected to the mast posts, mounting structure for connecting and disconnecting the loader relative to a fore-and-aft extending tractor frame comprising:

a rear support assembly mounted on the tractor frame including means for pivotally supporting the lower ends of the mast posts from the frame for rocking about a generally transverse axis;

a transverse member connected between the forward ends of the mast arms;

means for rocking the mast about the rear support assembly and moving the transverse member in an arc-shaped path between a downwardly directed storage position and a raised mounted position;

a front support assembly connected to the forward end of the tractor frame and opening downwardly into the path of the transverse member for receiving the transverse member as the transverse member approaches the mounted position;

means for releasably latching the transverse member to the front support assembly in the raised mounted position;

wherein the front support assembly comprise downwardly opening U-shaped structure lying generally along the arc-shaped path and the means for latching includes a latch movable under the transverse member as the member moves up into the U-shaped structure, and wherein the latch includes an upright member pivotally connected at its upper end to the front support assembly for movement between a latching position wherein the lower end of the upright member is located in the arc-shaped path and an unlatching position away from the arc-shaped path.

5. The invention as set forth in claim 4 wherein the upright member includes a lower extension, and including remotely actuatable block structure for releasably securing the upright member in the latching position with the lower extension projecting under the transverse member.

6. The invention as set forth in claim 1 wherein the rear support assembly includes upwardly opening cradle structure for freely receiving the lower ends of the mast posts when the transverse member is in the storage position.

7. The invention as set forth in claim 6 including an extension located at the lower end of the mast posts and rotatable with the mast posts between a cradle non-contacting position corresponding to the storage position, and a cradle contacting position corresponding to the mounted position wherein free release of the lower ends from the cradle structure is prevented.

8. The invention as set forth in claim 7 wherein the extension is rotatable about the axis through a preselected path and the cradle assembly includes a locking block located in the preselected path.

9. In a loader having a mast including rear upright mast posts and mast arms extending forwardly from the mast posts, said loader also having a boom assembly pivotally connected to the mast posts, mounting structure for connecting and disconnecting the loader relative to a fore-and-aft extending tractor frame comprising:

a rear support assembly mounted on the tractor frame including means for pivotally supporting the lower ends of the mast posts from the frame for rocking about a generally transverse axis;

a transverse member connected between the forward ends of the mast arms;

means for rocking the mast about the rear support assembly and moving the transverse member in an arc-shaped path between a downwardly directed storage position and a raised mounted position;

a front support assembly connected to the forward end of the tractor frame and opening downwardly into the path of the transverse member for receiving the transverse member as the transverse member approaches the mounted position;

means for releasably latching the transverse member to the front support assembly in the raised mounted position;

wherein the rear support assembly includes upwardly opening cradle structure for freely receiving the lower ends of the mast ports when the transverse member is in the storage position, and pinless means for preventing the lower ends of the mast posts from separating from the rear support assembly when the mast is rocked upwardly into the mounted position, wherein the pinless means comprises an extension located at the lower end of the mast posts and rotatable with the mast posts between a non-interfering position relative to the cradle structure, corresponding to the storage position, and an interfering position in contact with the cradle structure, corresponding to the mounted position;

wherein the extension is rotatable about the axis through a preselected path and the cradle assembly includes a locking block located in the preselected path; and wherein the lower ends of the mast posts include transverse tubular members and the cradle structure defines forwardly and upwardly directed openings for receiving the tubular members, the openings including means converging in the rearward direction for wedging the tubular members tightly in the cradle structure as the extension contacts the locking block.

10. The invention as set forth in claim 9 including means for adjusting the locking block relative to the path of the extension to assure a tight fit between the cradle assembly and mast posts when the mast is in the raised mounted position.

11. The invention as set forth in claim 1 wherein the front support assembly comprises a box-like structure, means for securing the box-like structure to the front of the tractor, and means for supporting front end weights from the box-like structure when the loader is disconnected from the tractor.

12. In a loader having a mast including rear upright mast posts and mast arms extending forwardly from the mast posts, said loader also having a boom assembly pivotally connected to the mast posts, mounting structure for connecting and disconnecting the loader relative to a fore-and-aft extending tractor frame comprising:

a rear support assembly mounted on the tractor frame including means for pivotally supporting the lower ends of the mast posts from the frame for rocking about a generally transverse axis;

actuating means for lowering the lower ends of the mast posts onto the rear support assembly and rocking the mast about the axis between a lowered storage position and a raised mounted position;

a front support assembly including means for releasably securing the forward ends of the mast arms to the forward end of the tractor frame when the mast is in the mounted position;

said rear support assembly including upwardly opening cradle structure defining upwardly and forwardly extending passageways for receiving said lower ends when the mast is generally in the storage position and further including a block structure offset adjacent the passageways;

said lower ends of the mast posts including transversely extending pivot tubes for receipt within the passageways, extension means projecting radially from the pivot tubes and rockable with the mast between a first downwardly and rearwardly directed position for free receipt within the passageways when the mast is in the storage position, and a second securing position wherein the extension means is offset from the passageways and contacts the block structure when the mast is in the raised mounted position for securing the mast posts in the cradle structure.

13. The invention as set forth in claim 12 wherein the extension means comprises an extension fixed to and projecting radially from one of the pivot tubes for rotation with the pivot tube about the axis with the mast, and the block structure includes a block located in the rotational path of the extension, said extension contacting the block as the mast approaches the mounted position.

14. The invention as set forth in claim 13 wherein the extension projects downwardly generally in a direction parallel to the mast posts, the cradle structure includes an extension-receiving area located below the corresponding passageway, and said block is located in the extension-receiving area.

15. The invention as set forth in claim 14 including means for adjusting the block relative to the rotational path of the extension.

16. The invention as set forth in claim 12 wherein the cradle structure includes downwardly converging bearing structure for receiving the pivot tubes and supporting the tubes with the axes of the tubes generally defining the transverse axis about which the mast rotates.

17. The invention as set forth in claim 16 wherein the extension means includes means for tightly wedging the pivot tubes in the converging bearing structure.

18. The invention as set forth in claim 12 including a transverse member connected between the forward ends of the mast arms for rotation about the transverse axis in an arc-shaped path between a lowered storage position and a raised mounted position, said front support assembly including downwardly opening receiving means located in the arc-shaped path for intercepting the transverse member, said means for releasably securing including remotely actuatable latching structure for releasably locking the transverse member in the receiving means.

19. The invention as set forth in claim 18 wherein the actuating means comprises a boom cylinder attachable to the tractor.

20. The invention as set forth in claim 18 wherein the front support assembly includes means for supporting tractor front end weights when the loader is disconnected from the tractor.

21. The invention as set forth in claim 12 including a support stand extending downwardly from the forward ends of the mast arms, wherein the mast pivots about the stand as the mast posts are lowered onto the rear support assembly.

* * * * *